US012504248B2

(12) United States Patent
Dombrowski

(10) Patent No.: US 12,504,248 B2
(45) Date of Patent: Dec. 23, 2025

(54) INSULATING QUICK INTERFACING FIREARM HANDGUARD ACCESSORY WITH ELONGATED APERTURE

(71) Applicant: Alex Jon Dombrowski, Fort Mohave, AZ (US)

(72) Inventor: Alex Jon Dombrowski, Fort Mohave, AZ (US)

(73) Assignee: XTech Tactical, LLC, Tempe, AZ (US)

( * ) Notice: Subject to any disclaimer, the term of this patent is extended or adjusted under 35 U.S.C. 154(b) by 0 days.

(21) Appl. No.: 18/671,533

(22) Filed: May 22, 2024

(65) Prior Publication Data

US 2025/0362102 A1 Nov. 27, 2025

Related U.S. Application Data

(60) Provisional application No. 63/468,787, filed on May 24, 2023.

(51) Int. Cl.

| | |
|---|---|
| ***F41C 27/00*** | (2006.01) |
| ***F41A 13/12*** | (2006.01) |
| ***F41A 21/44*** | (2006.01) |
| ***F41C 23/16*** | (2006.01) |

(52) U.S. Cl.

CPC ..... *F41A 21/44* (2013.01); *F41A 13/12* (2013.01); *F41C 27/00* (2013.01)

(58) Field of Classification Search

CPC ..... F41C 23/16

See application file for complete search history.

(56) References Cited

U.S. PATENT DOCUMENTS

| | | | | |
|---|---|---|---|---|
| D676,920 | S * | 2/2013 | Fitzpatrick | D22/108 |
| 8,695,261 | B2 * | 4/2014 | Troy | F41C 23/16 42/71.01 |
| D704,791 | S * | 5/2014 | Fitzpatrick | D22/108 |
| D729,337 | S * | 5/2015 | Boone | D22/108 |
| 9,222,749 | B1 * | 12/2015 | Nakayama | F41A 35/02 |
| 9,625,233 | B2 * | 4/2017 | Daniel | F41G 11/003 |
| 9,766,035 | B2 * | 9/2017 | Storch | F41C 23/16 |
| 9,989,328 | B2 * | 6/2018 | Ding | F41A 35/02 |
| 10,571,218 | B2 * | 2/2020 | Cahill | F41C 27/00 |
| 11,371,803 | B2 * | 6/2022 | Michal | F41C 27/00 |
| 2003/0074822 | A1 * | 4/2003 | Faifer | F41C 23/16 42/71.01 |
| 2011/0173862 | A1 * | 7/2011 | Williams | F41C 23/12 42/71.01 |

(Continued)

*Primary Examiner* — Derrick R Morgan

(57) ABSTRACT

An insulated handguard rail panel insert with an elongated aperture that extends through the entirety of the component allowing for the passage of any fluid media past a barrel, gas-system, or any other internal thermally conductive parts of a firearm. The rail panel is designed to be placed within an attachment section of a firearm handguard by firmly pressing it down, causing the engagement fins to contact the interior surface of the handguard. Once installed, the insert acts as a thermally insulating barrier between the thermally conductive metal handguard and the user. It securely attaches to a firearm without the need for any additional manufacturing processes such as the addition of fasteners, cams, bolts, or other hardware in which the method of retention does not impede or obstruct the flow of fluid media through the elongated aperture.

7 Claims, 7 Drawing Sheets

(56) References Cited

U.S. PATENT DOCUMENTS

| | | | | |
|---|---|---|---|---|
| 2016/0091272 | A1* | 3/2016 | Hines | F41C 23/16<br>42/90 |
| 2020/0033091 | A1* | 1/2020 | Michal | F41C 27/00 |

* cited by examiner

INSULATING QUICK INTERFACING FIREARM HANDGUARD ACCESSORY WITH ELONGATED APERTURE

CLAIM OF PRIORITY

This application claims the benefit of U.S. Provisional Patent Application No. 64/468,787 filed May 24, 2023, which is incorporated by reference herein in its entirety.

CROSS REFERENCE

This application relates in-part to U.S. Design patent application Ser. No. 29/891,334 filed May 20, 2023 in which the design is incorporated by reference herein in its entirety.

FIELD OF DISCLOSURE

The present invention relates to the field of firearms and more particularly relates to an improved quick interfacing firearm grip enhancement and insulation accessory.

BACKGROUND

Contemporary firearms, specifically rifles, carbines, and pistols utilized in military and civilian settings, can be employed in a multitude of diverse situations.

The modern firearm functions by utilizing a controlled explosion of hot gases to create a pressure difference that propels a projectile down the length of a barrel. This pressure difference accelerates the projectile forward and out of the firearm.

A byproduct of this controlled explosion is the generation of thermal energy, which is dispersed to all thermally conductive surfaces of the firearm by means of conductive and convective heat transfer.

To achieve a reduction in the transfer of thermal energy to the user; those knowledgeable in the art have introduced an air gap between the conducting surfaces and the firearms hand guard, rail or fore end. This insulating air gap drastically reduces the rate at which conductive heat it transferred. However, prolonged use may still result in heat transfer by means of convective heat transfer through the ambient air or other fluid media in the gap created between the hot components and the hand guard or rail system.

These hand guard systems are often constructed out of materials that are thermally conductive and feature unique industry specific mounting slots that utilize distinct shapes, depths, and configurations that not only serve as attachment points for accessories but also play a secondary role in that they allow ambient air or other fluid media to flow into the conductive hand guard and past hot components delivering a cooling effect to the conductive surfaces as thermal energy is absorbed by cooler ambient air or other fluid media and naturally ejected from the firearm handguard.

However, when an accessory slot is occupied; it no longer possesses the ability to allow ambient air or other fluid media to flow into and past the conductive components of the firearm.

Therefore, there is a need in the art to insulate the user of a firearm from this heat transfer and allow ambient air or other fluid media to flow past the component when installed in the attachment location of a hand guard as an insulating contact surface.

SUMMARY OF THE DISCLOSURE

Numerous aspects of this disclosure will become apparent from the subsequent exposition and attached claims, with reference to the accompanying illustrations that are an integral part of this specification, where similar reference symbols identify corresponding components in the various perspectives.

An exemplary quick interfacing firearm handguard accessory with elongated aperture is provided. The quick interfacing firearm handguard accessory with elongated aperture is a component constructed of one or more materials which exhibit properties known in the art to insulate from the transfer of conductive heat and can be manufactured using any number of plastic or polymer injection methods or additive manufacturing technologies. All sections, bodies, or individually referenced components of the quick interfacing firearm handguard accessory with elongated aperture (current embodiment, the embodiment) by nature of the process in which it is manufactured, are one continuous body and only separated for the purpose of reference herein.

An insulating contact surface sits atop an engagement base. The insulating contact surface extends horizontally more than vertically and sweeps around the most external path of the elongated slot. The elongated slot extends horizontally more than vertically in like style and shape of the slotted aperture of the firearm handguard. The engagement base sits below the insulating contact surface and is shaped in such a way as to contact the inner face of the slotted aperture of a firearm handguard with its most exterior face. The engagement fins extend horizontally more than vertically and are located at the bottom most edge of the interfacing base. The engagement fins are constructed in such a way as to return to normal shape after insertion into a slotted aperture of a firearm handguard and engage the interior face of the slotted aperture. The embodiment is constructed in such a way as to control rigidity of individual components by exploiting a materials hardness, ductility, and other properties in conjunction with the components location on the embodiment, thickness of the component, and edges that contact other components of the embodiment—all of which contribute to the embodiments unique properties and claims to follow.

Before explaining at least one embodiment of the invention in detail, it is to be understood that the invention is not limited in its application to the details of construction and the arrangements of the components set forth in the following description or illustrated drawings. The invention is capable of other embodiments and of being practiced and carried out in various ways. It should be understood that the phraseology and terminology employed herein are for the purpose of description and should not be regarded as limiting.

As such, those skilled in the art will appreciate that the conception, upon which this disclosure is based, may readily be utilized as a basis for developing other quick interfacing grip surfaces with a elongated slotted design, including structures, systems, and methods. It is important that the claims be regarded as including equivalent constructions insofar that they do not depart from the scope of the present invention.

DETAILED DESCRIPTION

Figure 1:
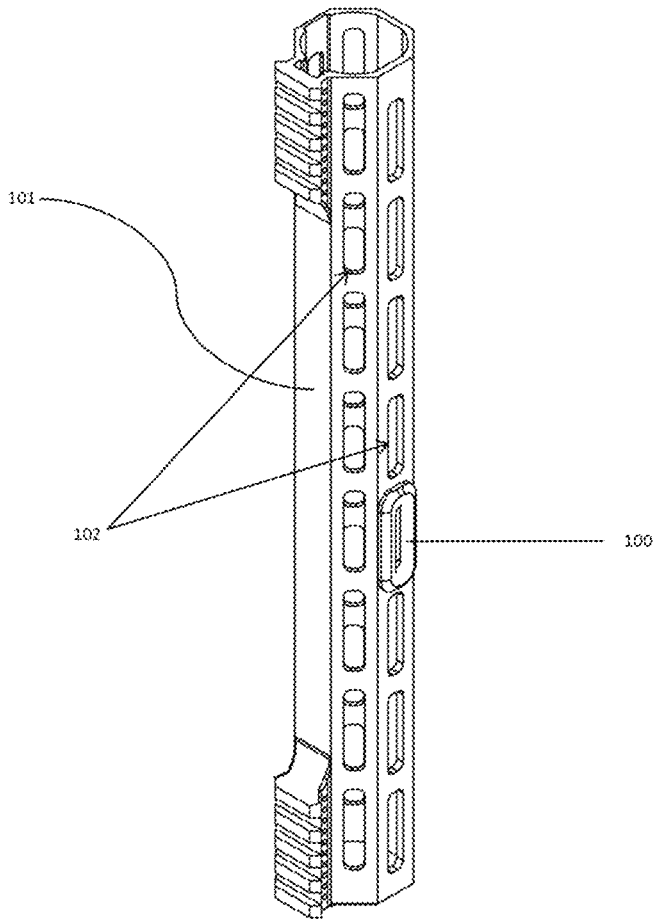
FIG. 1 is a perspective view of a firearm hand guard removably coupled to a slotted quick interfacing panel insert.
Figure 2:
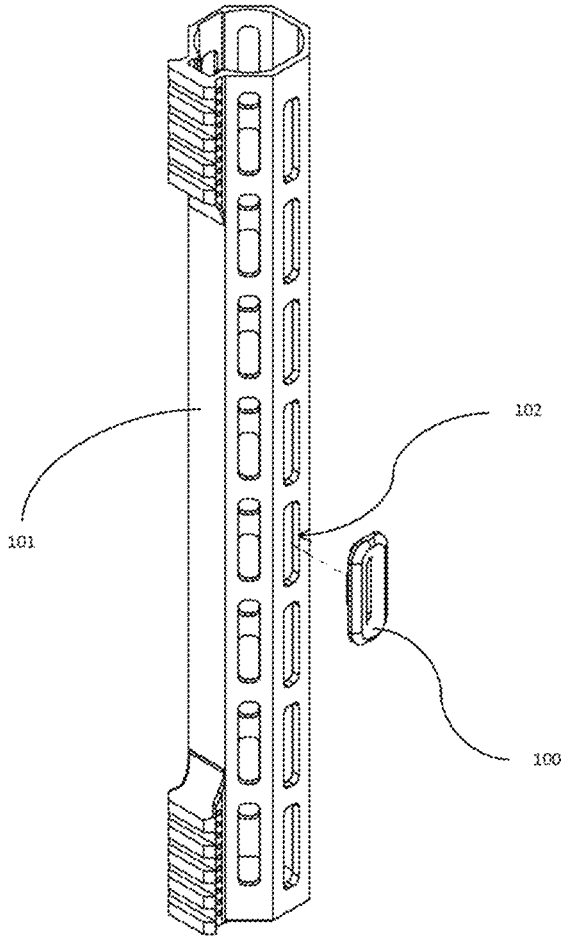
FIG. 2 is an expanded view of a firearm hand guard removably coupled to a slotted quick interfacing panel insert.

Referring now to FIG. 1, there is shown a quick interfacing firearm handguard accessory with elongated aperture 100 removably coupled to a firearm hand guard assembly according to the present disclosure. The quick interfacing firearm handguard accessory with elongated aperture 100 as shown sits inside any slotted aperture 102 of any firearm handguard assembly 101, rail system, or heat shroud that is equipped with slotted apertures that extend horizontally more than vertically and symmetrically from the center horizontally and symmetrically from the center vertically.

Figure 5:
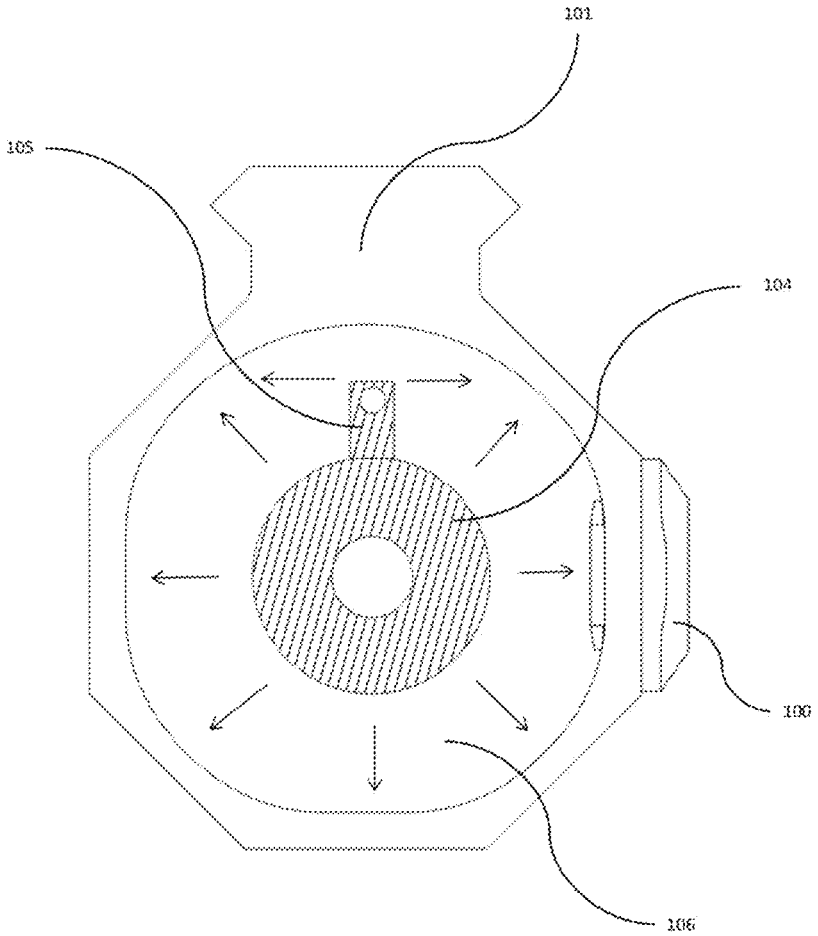
FIG. 5 is a frontal section view of a firearm handguard removably coupled to a slotted quick interfacing panel insert showing path of thermal energy.
Figure 6:
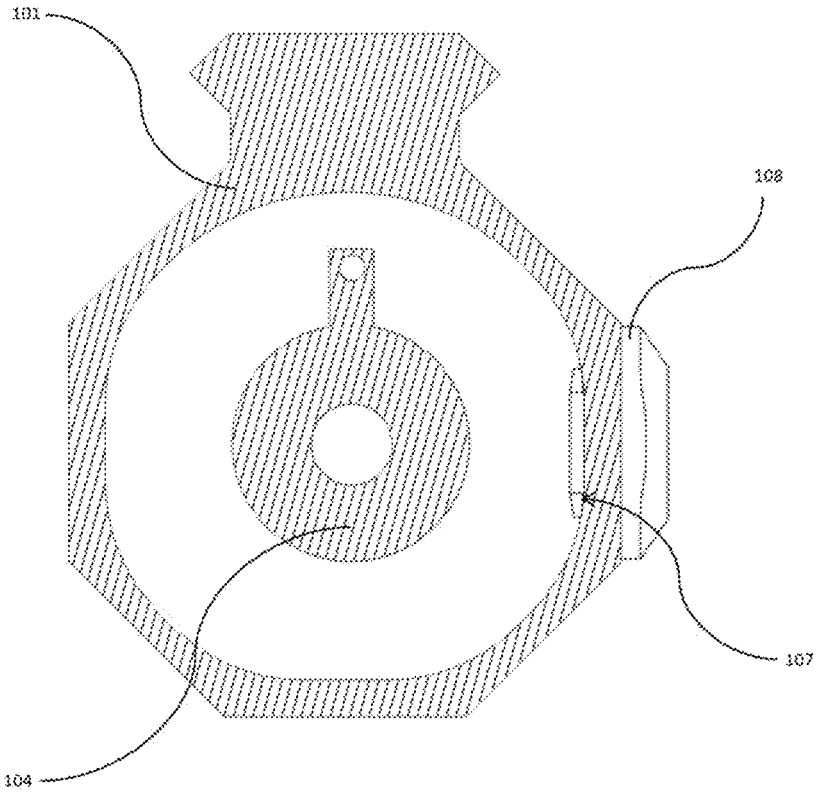
FIG. 6 is a frontal section view of a firearm handguard removably coupled to a slotted quick interfacing panel insert.

Referring now to FIG. 5, there is shown a section view of a firearm hand guard assembly 101 consisting of a barrel 104 and gas-system 105 that of which the gas-system 105 sits removably coupled to the barrel 104 and where the darkened region of the figure represents a source of thermal energy. FIG. 5 shows the heat transfer from a barrel 104 and gas-system 105 by means of convection in which the arrows represent the transfer of heat to the firearm hand guard assembly 101 where the assembly receives thermal energy through any fluid media 106. The firearm hand guard assembly 101 can be removably coupled to any semi-automatic or fully automatic gas operated, piston operated, or mechanically operated or cycled firearm in which heat is transferred through any fluid media 106 to any assembly that is used to grip a firearm by an operator or user that contains slotted apertures that extend horizontally more than vertically and symmetrically from the center vertically and symmetrically from the center horizontally.

Figure 3:
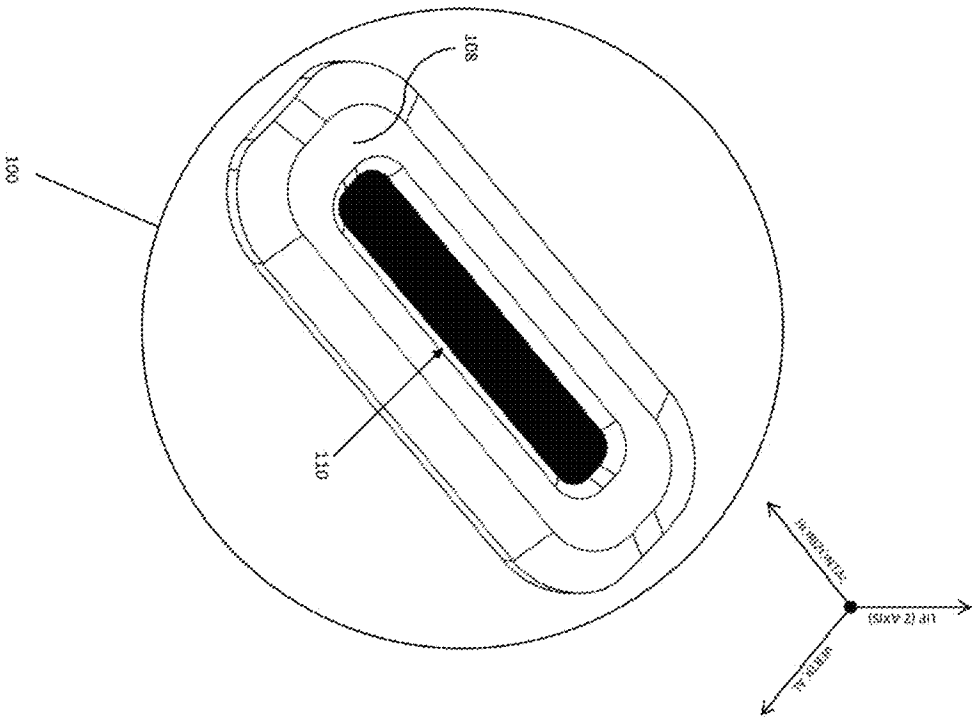
FIG. 3 is a perspective view of a slotted quick interfacing panel insert.

Referring now to FIG. 3, which depicts an embodiment of the current invention 100, shown is a quick interfacing accessory for firearm handguards with an elongated aperture. The embodiment 100 is an insert for firearm handguards, featuring a centrally located elongated slot 110 that in which is shaded for illustrational purposes. The elongated slot 110 extends horizontally more than vertically, mirroring the slotted aperture 102 at scale. The elongated slot 110 is responsible for allowing cooler ambient air or other fluid media to enter the firearm handguard through the elongated slot. After entering the firearm handguard, the cooler ambient air or other fluid media encounters the barrel 104 and gas-system 105 or other components known in the art to possess the potential to be thermally conductive. Thermal energy is transferred to the ambient air which eventually leaves the system through any other aperture.

Additionally, an insulating contact surface 108 surrounds the elongated slot 110, providing a thermally insulating contact surface with a moderate to high friction coefficient. The insulating contact surface 108 is responsible for providing an enhanced grip surface to the user as well as, upon insertion into the slotted aperture 102, preventing the interfacing latching fins 107 from over traveling into the slotted aperture 102. The component is constructed in such a way as to allow the interfacing fins 107 to engage at the same time the insulating contact surface meets the slotted apertures 102 external face.

The quick interfacing firearm handguard accessory with elongated aperture 100 is manufactured by utilizing a negative mold, into which liquefied, molten, or heated thermoplastics are injected to shape the final product which is then cooled to form the quick interfacing firearm handguard accessory with elongated aperture 100. The quick interfacing firearm handguard accessory with elongated aperture 100 can also be recreated, formed, assembled, or manufactured by means of any current or future form of additive manufacturing including stereolithography (SLA), selective laser sintering (SLS), fused deposition modeling (FDM), digital light process (DLP), multi jet fusion (MJF), polyjet, direct metal laser sintering (DMLS), and electron beam melting (EBM) or any process utilizing a thermoplastic or blend of thermoplastics to construct the embodiment 100.

Figure 4:
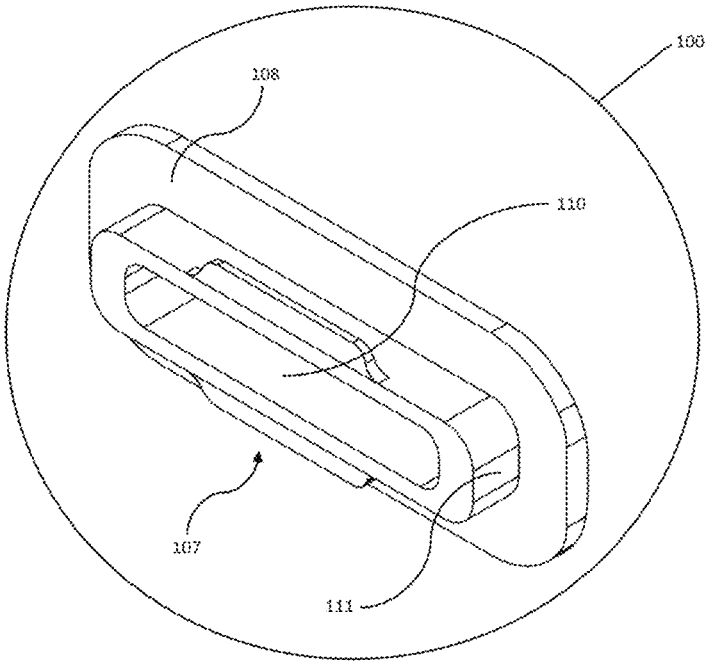
FIG. 4 is a bottom perspective view of a slotted quick interfacing panel insert.

FIG. 4 illustrates a bottom perspective view of the quick interfacing firearm handguard accessory with elongated aperture 100 in which the elongated slot 110, interfacing base 111, slotted aperture interfacing fins 107, and interior face of the insulating contact surface 108 can be seen.

The interfacing base 111 extends horizontally more than vertically in similar fashion, form, and style to the slotted aperture 102. The slotted aperture interfacing fins 107 are positioned in such a way that they extend vertically less than horizontally and engage the interior face of the slotted aperture 107 of FIG. 1. The present embodiment 100 is locked, retained, or otherwise secured into the slotted aperture 102 by utilizing a two-pronged method of retention: the interfacing base 111 is constructed in such a way that the exterior face of the interfacing base 111 experiences a high friction coefficient between the inside face of the slotted aperture 102, and the engagement of the slotted aperture interfacing fins 107 on the slotted aperture's 102 interior face.

Figure 7:
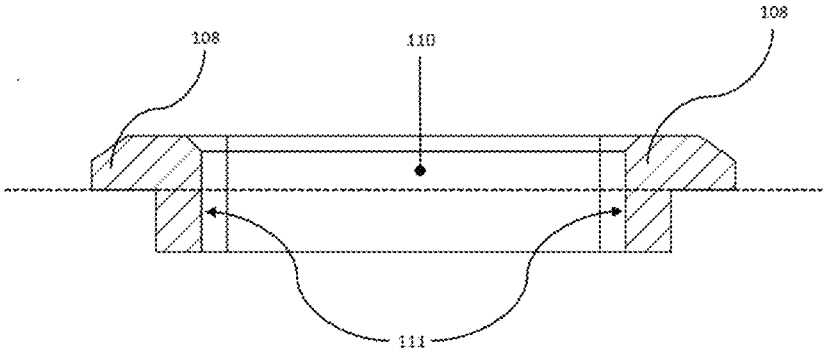
FIG. 7 is a horizontal section view of a slotted quick interfacing panel insert.

Referring now to FIG. 7 which illustrates a horizontal section view of the present embodiment 100. The insulating contact surface 108 rests atop the interfacing base 111. The insulating contact surface 108 is shaped in such a way as to provide more surface area as compared to the flat face surrounding the slotted aperture 102 of FIG. 1 and provides a higher friction coefficient than conducting metals which are used in the art. The elongated slot 110 extends through the entirety of the component creating a void which is not obstructed by any form of retention mechanism, cam system, mounting hardware, or other mounting solution which allows ambient air or other fluid media or other fluid media to flow completely through the component 100.

Figure 8:
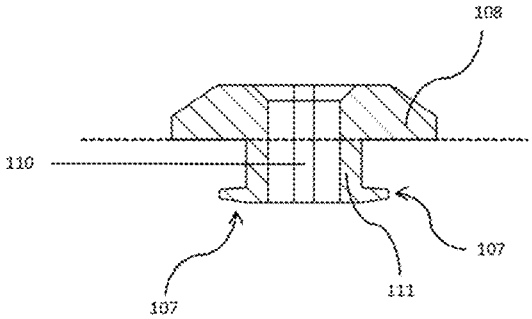
FIG. 8 is a frontal section view of a slotted quick interfacing panel insert.

In reference to FIG. 8 which illustrates a frontal section view of the present embodiment 100 in which the slotted aperture interfacing fins 107 are seen attached to the interfacing base 111 at its lowest point. The elongated slot 110 extends through the entirety of the component. The dashed line represents the boundary in which the insulating contact surface 108 meets the interfacing base 111.

Although the present invention has been described with reference to preferred embodiments, numerous modifications, and variations can be made and still the result will come within the scope of the invention. No limitation with respect to the specific embodiments disclosed herein is intended or should be inferred.

REPRESENTED BODIES

100—Quick interfacing firearm handguard accessory, the embodiment, the current invention, the assembly

101—Firearm handguard assembly
102—Slotted aperture of a firearm handguard assembly
104—Firearm barrel
105—Firearm gas system
106—Any fluid media
107—Interfacing fins
108—Insulating contact surface
110—Elongated slot
111—Interfacing base

What is claimed is:

1. An insulating firearm handguard rail panel insert comprising:

a non-metallic component formed of a thermally insulating material;

an elongated slot extending through the component to allow for the passage of fluid media; and an interfacing base comprising a retention structure integrally molded with the component and configured to secure the insert within a slotted aperture of a firearm handguard without the use of additional or supplementary components; and wherein the elongated slot extends through the retention structure and the elongated slot has a geometric profile that substantially conforms to the shape of the slotted aperture of the firearm handguard into which the component is secured.

2. The insulating firearm handguard rail panel insert of claim 1, wherein the component is configured such that heat transfer between the component and the surrounding handguard aperture is minimized during operation.

3. The insulating firearm handguard rail panel insert of claim 1, wherein the component further comprises a protruding grip surface.

4. The insulating firearm handguard rail panel insert of claim 3, wherein the retention structure does not obstruct the flow of any fluid media through the elongated slot.

5. The insulating firearm handguard rail panel insert of claim 1, wherein the elongated slot extends horizontally more than vertically along a longitudinal axis of the component.

6. The insulating firearm handguard rail panel insert of claim 1, wherein the elongated slot allows any fluid media to flow through the component when the component is mounted within the slotted aperture of the firearm handguard.

7. The insulating firearm handguard rail panel insert of claim 1, wherein the component is secured into the slotted aperture of a firearm handguard solely by integrally molded retention features of the component and without requiring any separate locking elements, fasteners, or supplementary securing components.

* * * * *